US006736411B2

(12) United States Patent
Wang et al.

(10) Patent No.: US 6,736,411 B2
(45) Date of Patent: May 18, 2004

(54) LOCKING DEVICE FOR A DETACHABLE SKATE OF SPORT SHOE

(75) Inventors: Chen-Wen Wang, No. 34-6, Chia Fu Li, Chia-Li Town, Tainan Hsien (TW); Chun-Cheng Chang, Tainan Hsien (TW); Hong-Young Chiu, Tainan Hsien (TW)

(73) Assignee: Chen-Wen Wang, Tainan Hsien (TW)

( * ) Notice: Subject to any disclaimer, the term of this patent is extended or adjusted under 35 U.S.C. 154(b) by 0 days.

(21) Appl. No.: 10/142,782

(22) Filed: May 13, 2002

(65) Prior Publication Data

US 2003/0155724 A1 Aug. 21, 2003

(30) Foreign Application Priority Data

Feb. 20, 2002 (TW) ..... 91202108 U

(51) Int. Cl.[7] ..... A63C 17/20
(52) U.S. Cl. ..... 280/7.13; 280/11.3; 280/613
(58) Field of Search ..... 280/7.13, 7.14, 280/7.12, 11.19, 11.221, 11.224, 11.27, 11.3, 613; 36/15, 115

(56) References Cited

U.S. PATENT DOCUMENTS 2,998,260 A * 8/1961 Meyer ..... 280/7.13
4,728,115 A * 3/1988 Pozzobon et al. ..... 280/613
4,932,675 A * 6/1990 Olson et al. ..... 280/7.13
5,088,749 A * 2/1992 Olivieri ..... 280/11.18
5,123,664 A * 6/1992 DeMars ..... 280/11.18
5,193,827 A * 3/1993 Olson ..... 280/7.13
5,507,506 A 4/1996 Shadroui ..... 280/11.22
5,741,019 A 4/1998 Lu ..... 280/11.22
5,797,608 A * 8/1998 Haldemann ..... 280/11.3
5,895,061 A * 4/1999 Gignoux ..... 280/11.214
5,992,873 A * 11/1999 Hauglin ..... 280/615
6,098,997 A 8/2000 Cheng ..... 280/11.28
6,131,924 A * 10/2000 Marmonier ..... 280/11.3
6,135,463 A * 10/2000 Wrike ..... 280/11.221
6,270,089 B1 8/2001 Marechal ..... 280/11.3
6,270,090 B1 8/2001 Gignoux ..... 280/11.33
6,334,621 B1 1/2002 Chang ..... 280/11.3
6,382,638 B1 5/2002 Lee ..... 280/7.13
6,572,121 B2 * 6/2003 Shih ..... 280/11.33

* cited by examiner

*Primary Examiner*—Brian L. Johnson
*Assistant Examiner*—Christopher Bottorff
(74) *Attorney, Agent, or Firm*—Bacon & Thomas, PLLC

(57) ABSTRACT

The locking device for a detachable skate of sports shoe in accordance with the present invention mainly comprises a rotatable hook, an elastic member, a lever and an engaging wall. The rotatable hook is provided on the detachable skate being adapted to releasably engaging with the engaging wall provided under the sports shoes. The elastic member is provided to bias the rotatable hook and the lever is used to rotate the rotatable hook for assembling or disassembling by means of overcoming bias force of the elastic member.

14 Claims, 5 Drawing Sheets

LOCKING DEVICE FOR A DETACHABLE SKATE OF SPORT SHOE

BACKGROUND OF THE INVENTION

1. Field of the Invention

The present invention is related to a locking device for a detachable skate of sports shoe and more particularly to a detachable ice/roller skate utilizes a locking device convenient to pivotally engage with or to release from a sports shoe.

2. Description of the Related Art

The technology trend in skates manufacturing has been toward convertible shoe with a detachable ice/roller skate. Attaching the detachable ice/roller skate to the convertible shoe capable of converting from a shoe into an ice/roller skate at will is known in the art. Also, detaching the detachable ice/roller skate, of course, capable of converting an ice/roller skate into a shoe for walking is known in the art. Thus, a skater can avoid carrying additional footwear for walking or other physical activity when the skates are not in use or are not allowed. A need exists for improved the construction of convertible shoes and facilitating their operation. Currently, with increasing demand for conveniently locking convertible shoes have evolved over the years.

U.S. Pat. No. 2,998,260, issued on Aug. 29, 1961 to Meyer, discloses a skate shoe and interchangeable roller and ice skates therefor. The skate shoe includes the combination of mounting plate secured beneath the sole of the shoe. This mounting plate is provided with a plurality of headed studs and a lug. A skate has a top plate matching the mounting plate having a plurality of keyhole slots and a locking slot. The keyhole slots are capable of receiving the headed studs when the shoe is placed upon the skate for retaining the shoe assembled with the skate. The lug is capable of inserting into the locking slot so that a screw mount lug and a locking screw thereof is adjusted to abut against the lug to effectively lock the shoe in place upon the top plate of the skate.

U.S. Pat. No. 6,120,038, issued on Sep. 19, 2000 to Dong et al., discloses a skate having a shoe portion detachably secured to a plurality of longitudinally aligned skate wheels for traversing a surface. The shoe portion having a sole defining a toe end and a heel end. The skate further includes a frame having an upper surface and a lower surface attached to the wheels. The skate also includes a heel latch member rotatably attached to the frame for receiving and coupling to a heel binding attachment surface located in the heel end of the sole to the frame. A lever arm is attached to the heel latch member to selectively release or attach the shoe portion from the heel latch member. The heel latch member is rotatable about a vertical axis extending normal to the elongate direction of the frame. The heel latch member is rotatable between a locked position, wherein the heel attachment member is nested therein, and an open position, wherein the frame is detachable from the shoe portion to convert the skate into a convention shoe. However, the structure of the heel latch member of No. 6,120,038 is complicated manufacturing process and therefore increases mass production cost.

A variety of other roller skates are particularly disclosed in U.S. Pat. Nos. 4,333,249; 5,314,199; 5,340,132; 5,507,506; 6,065,759; 6,120,039; 6,164,669 for example.

The present invention intends to provide a locking device of the skate simply comprising of a rotatable hook actuated by an elastic member for conveniently engaging with or releasing from an engaging wall of the sports shoe. The locking device of the skate accomplishes both conveniently combining the skate with the sports shoe and simplifying the entire structure of the skate in such a way to mitigate and overcome the above problem.

SUMMARY OF THE INVENTION

The primary objective of this invention is to provide a pivotal device for a detachable skate of sports shoe, which allows pivotal movement of the detachable skate with respect to the sports shoe during assembling or disassembling operation.

The secondary objective of this invention is to provide a locking device for a detachable skate of sports shoe comprising of a rotatable hook actuated by an elastic member for conveniently engaging with or releasing from an engaging wall of the sports shoe.

The another objective of this invention is to provide a locking device for a detachable skate of sports shoe comprising of a rotatable hook engaging with the engaging wall of the sports shoe that accomplishes to simplify the entire structure of the skate.

The present invention is a locking device for a detachable skate of sports shoe. The locking device mainly comprises a rotatable hook, an elastic member, a lever and an engaging wall. The rotatable hook is provided on the detachable skate being adapted to releasably engaging with the engaging wall provided under the sports shoes. The elastic member is provided to bias the rotatable hook and the lever is used to rotate the rotatable hook for assembling or disassembling by means of overcoming bias force of the elastic member.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
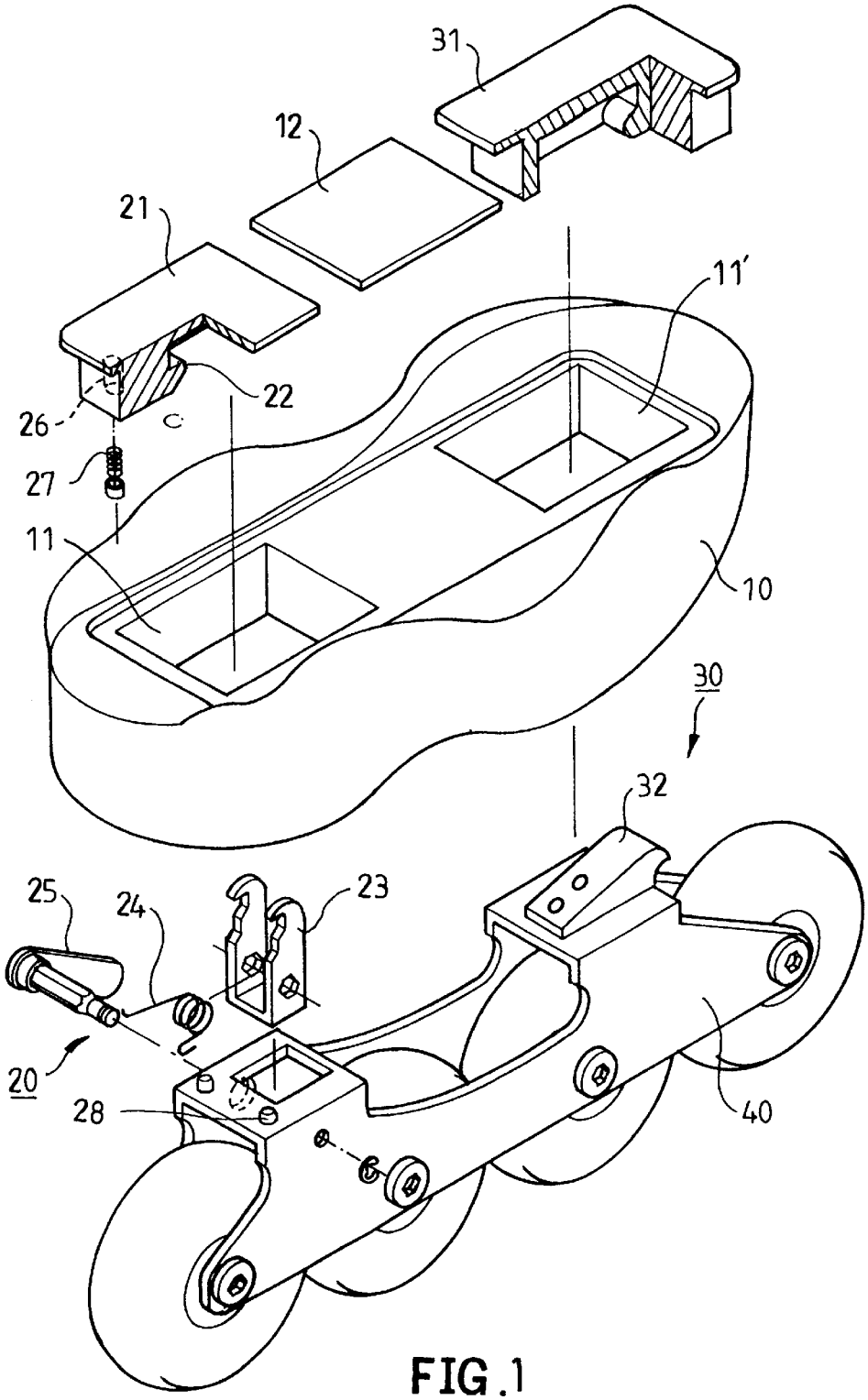
FIG. 1 is an exploded perspective view of the detachable skate of sports shoe in accordance with a first embodiment of the present invention.

Referring now to the drawings, there are two embodiments of the present invention shown therein, which include generally a primary sports shoe member and a secondary skate member.

Referring initially to FIGS. 1 through 4, a sports shoe 1 in accordance with the first embodiment of the present invention generally includes a sole designated as numeral 10, a locking device designated as numeral 20, a pivotal device designated as numeral 30 and a skate designated as numeral 40. Much of the detailed internal structure of the sports shoe 1 is omitted. The sole 10 comprises two cavities 11 and 11' at its underside each having an appropriate opening so as to contain the locking device 20 and the pivotal device 30 respectively. A pad 12 is fixed between the locking device 20 and the pivotal device 30. In addition, the detachable skate 40 is preferable an in-line roller skate or an ice skate (not shown) and constructs a locking member of the locking device 20 and a pivotal member of the pivotal device 30 on an uppermost portion of a main frame. The main frame (not labeled) essentially comprises a toe end and heel end.

Figure 2:
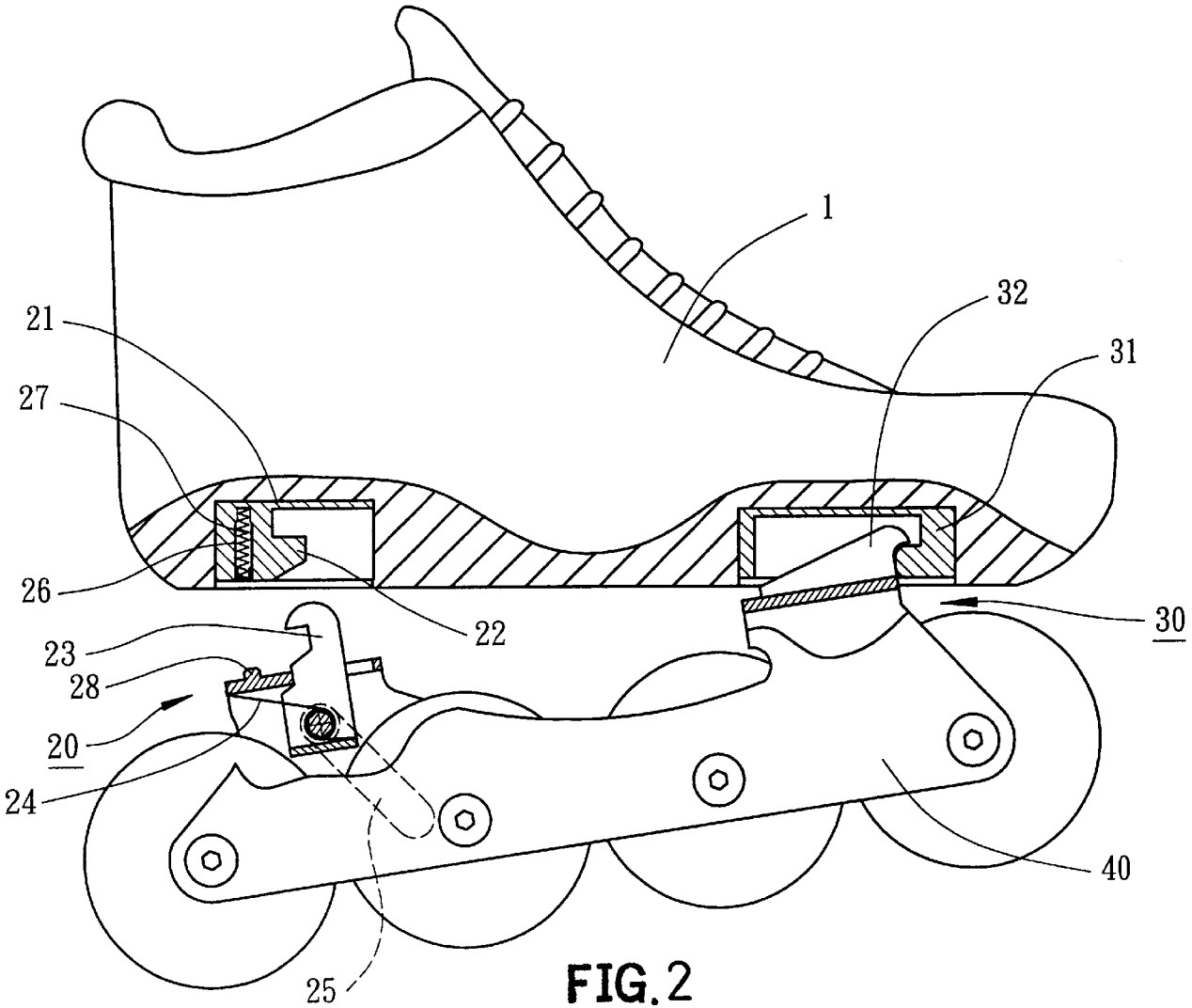
FIG. 2 is a partial cross-sectional view of the detachable skate of sports shoe in assembled operation in accordance with the first embodiment of the present invention.

Construction of the locking device 20 shall be described in detail, referring now to FIGS. 1 and 2. The locking device 20 in accordance with a first embodiment of the present invention mainly includes a locking seat 21, a rotatable hook 23, an elastic member 24 and a lever 25. The locking seat 21 is mounted to the sole 10 in the cavity 11. The locking seat 21 comprises an engaging wall 22 formed with a protrusion. The rotatable hook 23 is projected upward from the heel end of the skate 40 being adapted to releasably engage with the engaging wall 22 of the locking seat 21 in the cavity 11. The elastic member 24 is provided to bias the rotatable hook 23 and the lever 25 is used to rotate the rotatable hook 23 for disassembling by means of overcoming bias force of the elastic member 24. In addition, the locking seat 21 further comprises a pair of guiding holes 26 and elastic members 27 received therein. The heel end of the skate 40 further comprises a pair of guiding studs 28 being adapted to insert into the guiding holes 26 and thus biased by the elastic members 27.

The pivotal device 30 in accordance with the present invention allows pivotal movement of the skate 40 with respect to the sports shoe 1 during assembling or disassembling operation. Construction of the pivotal device 30 shall be described in detail, referring again to FIGS. 1 and 2. The pivotal device 30 in accordance with the first embodiment of the present invention mainly includes a pivotal seat 31 and a pivotal hook 32. The pivotal seat 31 is mounted to the sole 10 in the cavity 11'. The pivotal hook 32 is projected upward from the toe end of the skate 40 being adapted to releasably engage with the pivotal seat 31 in the cavity 11' while initially assembling.

Figure 3:
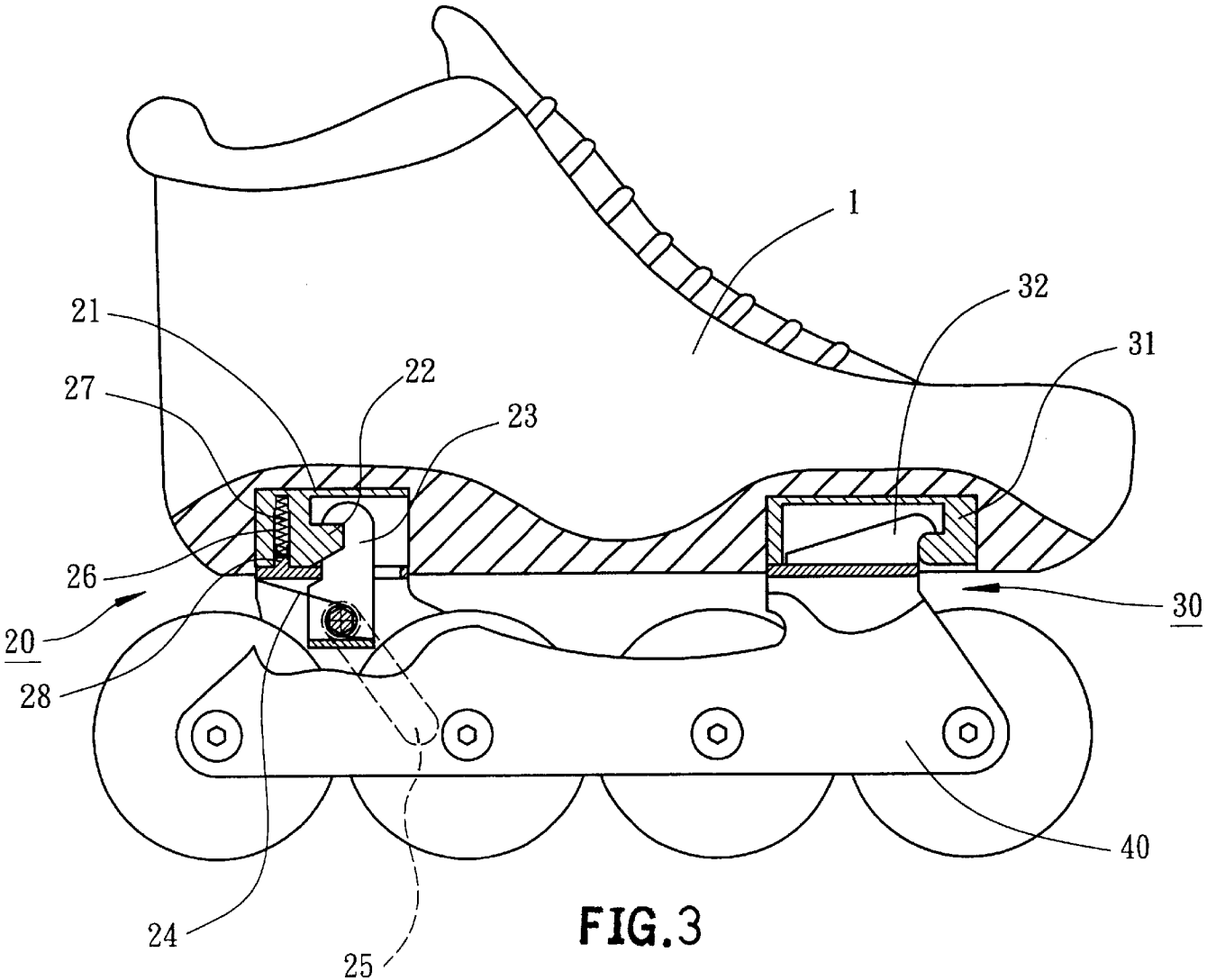
FIG. 3 is a partial cross-sectional view of the detachable skate of sports shoe in a locked position in accordance with the first embodiment of the present invention.

Assembling operation of the skate 40 with the sole 10 is described in third steps, referring now to FIGS. 2 and 3. In first step, the pivotal hook 32 is inserted into the pivotal seat 31. In second step, the skate 40 is rotated a predetermined angle with respect to the pivotal device 30 and the guiding studs 28 is inserted into the guiding holes 26. In third step, the guiding stud 28 is inserted into the guiding hole 26 and the rotatable hook 23 is completely engaged with the engaging wall 22.

Locked situation of the locking device shall now be described with reference back to FIG. 2. In locked position, the pivotal hook 32 is engaged with the pivotal seat 31 at the toe end of the sole 10 and the rotatable hook 23 is engaged with the locking seat 21 at the heel end. The lever 25 is capable of actuating to unlock the locking device 20 for detaching the skate 40.

Figure 4:
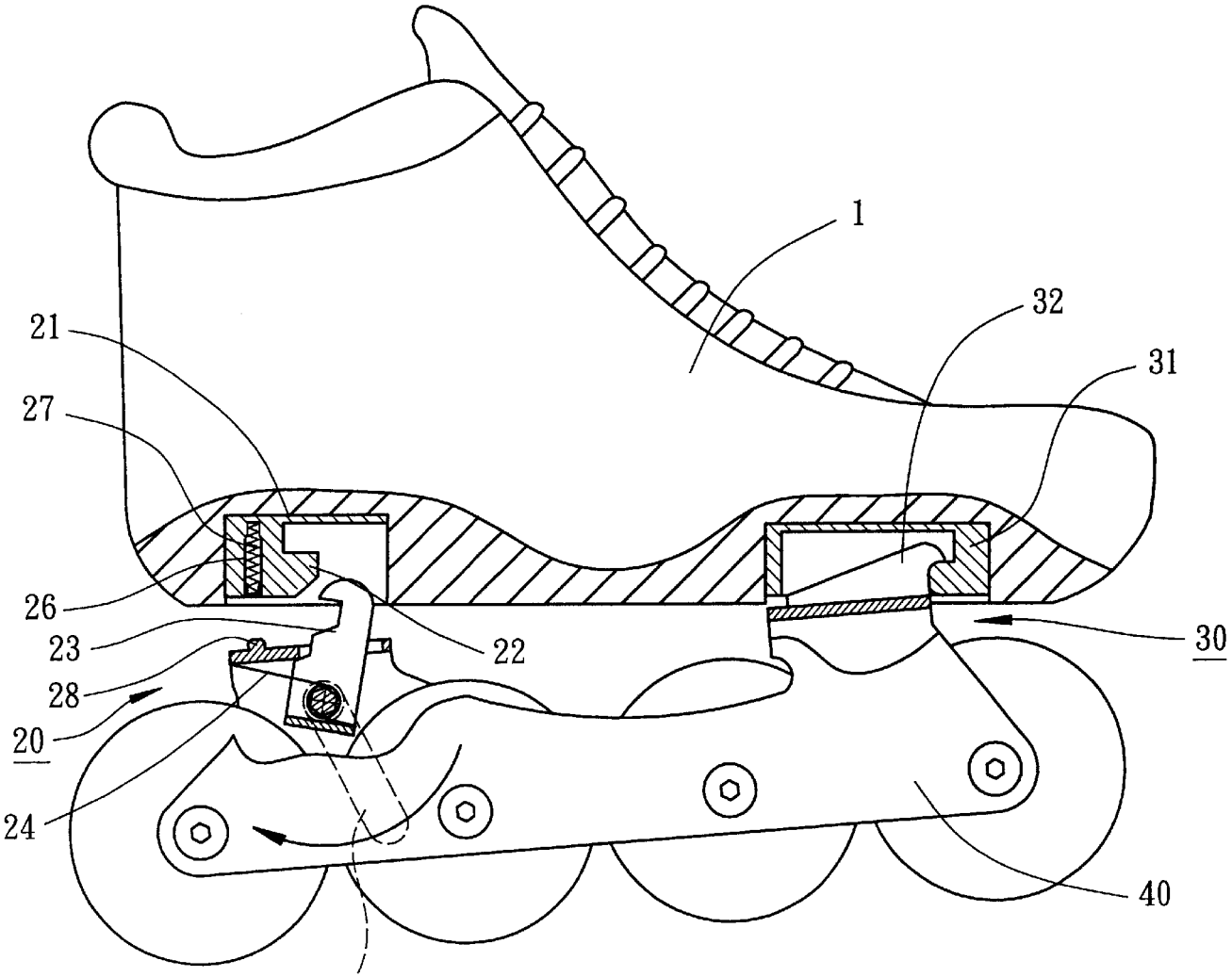
FIG. 4 is a partial cross-sectional view of the detachable skate of sports shoe in released operation in accordance with the first embodiment of the present invention.

Releasing operation of the locking device 20 shall now be described with reference now to FIG. 4. In releasing operation, the lever 25 is rotated a predetermined angle in clockwise direction to thereby disengage the rotatable hook 23 with the engaging wall 22. As the rotatable hook 23 rotates a predetermined angular distance round its axis, it is disengaged with the engaging wall 22. In released situation, the heek end of the skate 40 is automatically released from the sole 10 by means of bias force of the elastic member 27. The rotatable hook 23 is reciprocated at an original position by means of bias force of the elastic member 25 while releasing the lever 25.

Figure 5:
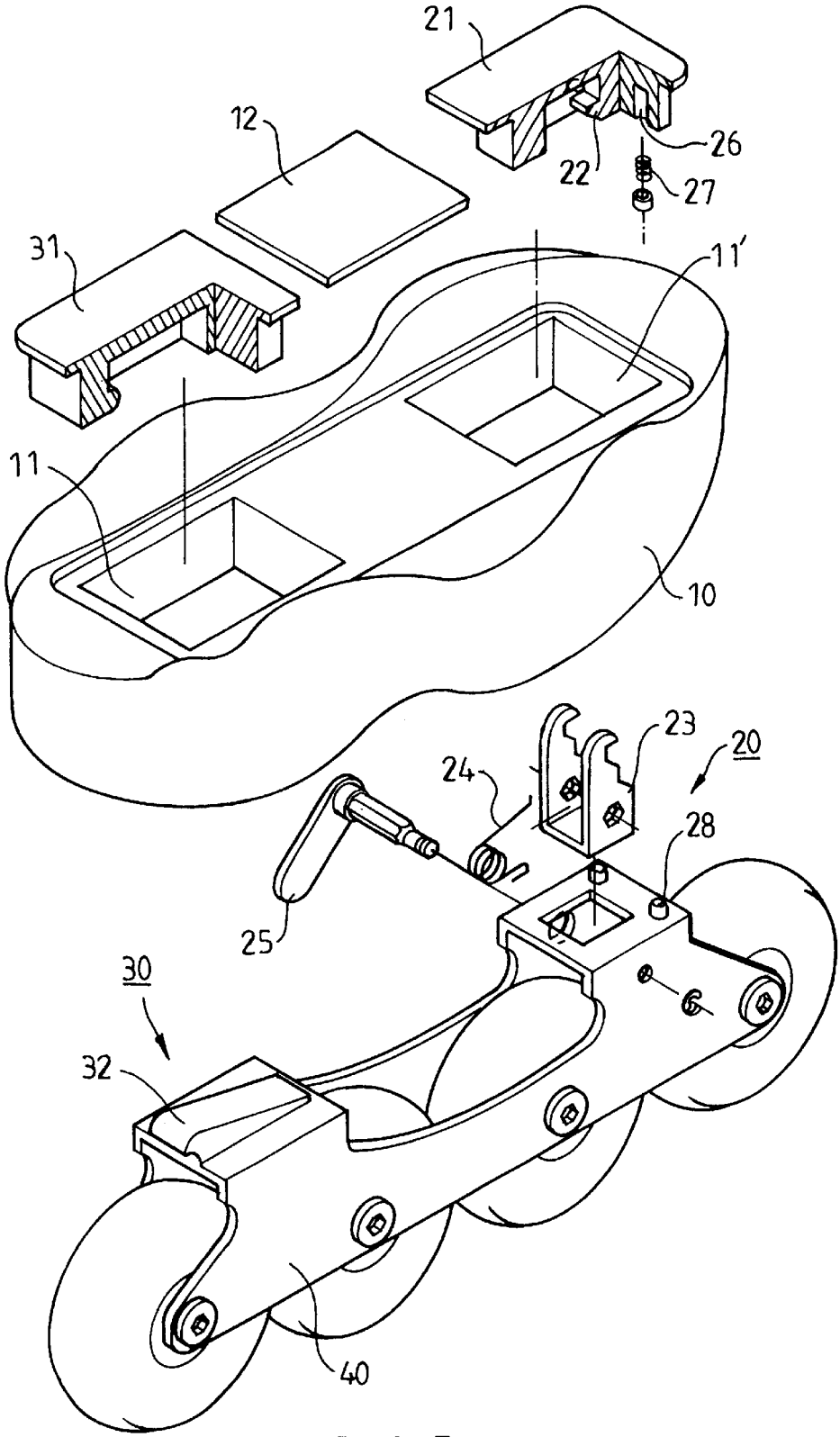
FIG. 5 is an exploded perspective view of the detachable skate of sports shoe in accordance with a second embodiment of the present invention.

Referring to FIG. 5, reference numerals of the second embodiment have applied the identical numerals of the first embodiment. The sports shoe 1, the sole 10, the locking device 20, the pivotal device 30 and the skate 40 of the second embodiment have the similar configuration and same functions as the first embodiment and the detailed descriptions are omitted. The locking device 20 and the pivotal device 30 in accordance with the first embodiment are provided on the heel and toe end of the sole 10 respectively. The positions of the locking device 20 and the pivotal device 30 in accordance with the second embodiment are interchanged in comparison with those of the first embodiment.

In assembling operation, the pivotal hook 32 provided on the skate is inserted into the pivotal seat 31 provided in the cavity 11' at the heel end of the sole 10. In locked position, the pivotal hook 32 is engaged with the pivotal seat 31 at the heel end of the sole 10 and the rotatable hook 23 is engaged with the locking seat 21 at the toe end.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A sports shoe including:

a sole having a first cavity and a second cavity at its underside;

a first device provided in the first cavity and being adapted to pivotally connect the sports shoe to a skate;

a locking device provided in the second cavity and being adapted to connect the sports shoe to the skate;

said first device allows pivotal movement of the skate with respect to the shoe while assembling or disassembling the sports shoe with the skate; said locking device comprises a locking seat with an engaging wall mounted to the sole and being adapted to releasably engage with a rotatable hook provided on the skate; said locking seat comprises a guiding hole and a first elastic member received therein, and a guiding stud provided on the skate and aligned with said guiding hole for being inserted into said guiding hole and biased by said first elastic member.

2. The sports shoe as defined in claim 1, wherein the first device includes a fixed seat mounted to the sole and being adapted to pivotally connect to a fixed hook provided on the skate.

3. The sports shoe as defined in claim 1, further comprises a lever being used to rotate said rotatable hook for assembling or disassembling operation.

4. The sports shoe as defined in claim 3, wherein the locking device further comprises second elastic member provided to bias said rotatable hook and said lever is used to rotate said rotatable hook by means of overcoming bias force of said second elastic member.

5. The sports shoe as defined in claim 1, wherein said rotatable hook is projected upward from the skate.

6. The sports shoe as defined in claim 5, wherein said rotatable hook is projected upward from a heel end of the skate.

7. The sports shoe as defined in claim 1, wherein the skate is an in-line roller skate.

8. A detachable skate device of a sports shoe including:

a main frame comprising a toe end portion and a heel end portion;

a first device provided on the main frame and being adapted to pivotally connect the skate to the sports shoe; and a locking device provided on the main frame and being adapted to connect the skate to the sports shoe;

said first allows pivotal movement of the skate with respect to the shoe while assembling or disassembling the skate with the sports shoe; said locking device comprises a rotatable hook provided on the skate and being adapted to releasably engage with a locking seat provided on the sports shoe;

said locking seat comprises a guiding hole and a first elastic member received therein, and a guiding stud provided on the detachable skate and aligned with said guiding hole for being inserted into said guiding hole and biased by said first elastic member.

9. The detachable skate device as defined in claim 8, wherein the first device includes a fixed hook provided on the skate and being adapted to pivotally connect to a fixed seat provided on the sports shoe.

10. The detachable skate device as defined in claim 8, further comprises a lever being used to rotate said rotatable hook for assembling or disassembling operation.

11. The detachable skate device as defined in claim 10, wherein the locking device further comprises a second elastic member provided to bias said rotatable hook and said lever is used to rotate said rotatable hook by means of overcoming bias force of said second elastic member.

12. The detachable skate device as defined in claim 8, wherein said rotatable hook is projected upward from the detachable skate.

13. The detachable skate device as defined in claim 12, wherein said rotatable hook is projected upward from a heel end of the detachable skate.

14. The detachable skate device as defined in claim 8, wherein the detachable skate is an in-line roller skate.

* * * * *